United States Patent [19]

Dmitrievsky et al.

[11] 4,217,313

[45] Aug. 12, 1980

[54] DEVICE FOR REDUCING NOXIOUS EMISSIONS FROM CARBURETOR INTERNAL COMBUSTION ENGINES

[76] Inventors: Anatoly V. Dmitrievsky, B. Cherkizovskaya ulitsa, 14, korpus 1, kv. 130; Vladimir F. Kamenev, Altufievskoe shosse, 18-v, kv. 121, both of Moscow; Jury M. Pashin, ulitsa Banykina 6, kv. 63, Tolyatti Kuibyshevskoi oblasti; Nikolai M. Prudov; Alexandr I. Simatov, both of prospekt Lenina, 40-a, kv. 28, both of Dimitrovgrad Ulyanovskoi oblasti; Andrei S. Tjufyakov, ulitsa Chugunnve vorota, 21, korpus 1, kv. 46., Moscow; Jury N. Shishkin, prospekt Lenina, 194; kv. 38; Jury I. Yamolov, Moskovsky proezd, 1/81, kv. 69, both of Tolyatti Kuibyshevskoi oblasti, all of U.S.S.R.

[21] Appl. No.: 898,917

[22] Filed: Apr. 21, 1978

[51] Int. Cl.[2] ..... F02M 3/04

[52] U.S. Cl. ..... 261/41 D; 261/DIG. 19; 261/DIG. 78; 261/79 R; 261/44 D; 123/320; 261/DIG. 74

[58] Field of Search ..... 261/41 D, DIG. 19, 44 D, 261/79 R, DIG. 78, 53, DIG. 74; 123/97 B

[56] References Cited

U.S. PATENT DOCUMENTS

| | | | |
|---|---|---|---|
| 1,373,550 | 4/1921 | Chandler | 261/44 D |
| 1,813,866 | 7/1931 | Royce | 261/44 D |
| 2,824,725 | 2/1958 | Dietrich | 261/DIG. 19 |
| 2,848,202 | 8/1958 | Leibing | 261/DIG. 19 |
| 3,371,914 | 3/1968 | Walker | 261/DIG. 19 |
| 3,544,083 | 12/1970 | Currie | 261/41 D |
| 3,547,089 | 12/1970 | Pierlot | 261/DIG. 19 |
| 3,688,752 | 9/1972 | Bandry | 261/DIG. 19 |
| 3,878,271 | 4/1975 | Garcea | 261/41 D |
| 3,944,634 | 3/1976 | Gerlach | 261/41 D |
| 3,953,548 | 4/1976 | Knapp et al. | 261/DIG. 78 |

FOREIGN PATENT DOCUMENTS

| | | | |
|---|---|---|---|
| 2053991 | 5/1972 | Fed. Rep. of Germany | 261/DIG. 78 |
| 2202699 | 8/1973 | Fed. Rep. of Germany | 261/DIG. 78 |

*Primary Examiner*—Tim R. Miles

*Attorney, Agent, or Firm*—Steinberg & Blake

[57] ABSTRACT

A device for reducing noxious emissions from carburetor engines of the internal combustion type, the body of which comprises at least one main passage designed for feeding a fuel-air mixture to the engine cylinders and has an emulsion passage. The main passage accommodates a throttle valve which divides it into an upstream throttle space and a downstream throttle space, as viewed in the direction of the fuel-air mixture flow. The emulsion passage communicates with the upstream throttle space substantially in the area where the throttle valve upper edge locates when the throttle valve is in the closed position and also communicates further, as viewed in the direction of the emulsion flow, via an adjustable throttle element with a chamber which communicates via an air passage with the upstream throttle space and via a passage with the downstream throttle space. The chamber accommodates a movable element adapted to move coaxially with the passage for the purpose of closing same. A sleeve is installed in the chamber in such a manner that a narrow annular passage is formed between the inner wall of the sleeve and the outer wall of the movable element. Said annular passage connects with the emulsion passage downstream of the adjustable throttling element with respect to the direction of the emulsion flow and separates the chamber space communicating with the downstream throttle space from the chamber space which communicates with the upstream throttle space.

6 Claims, 7 Drawing Figures

DEVICE FOR REDUCING NOXIOUS EMISSIONS FROM CARBURETOR INTERNAL COMBUSTION ENGINES

The present invention relates to internal combustion engines, more particularly, to devices for reducing noxious emissions from carburetor combustion ignition engines.

The invention can be used with particular advantage on motor vehicles operated in urban conditions and on mountain and cross-country roads and can also be used on any vehicle powered by a carburetor engine of the internal combustion type.

It is generally known that automobiles, particularly those powered by carburetor engines, are one of the primary sources of polluting the atmosphere with noxious fumes. A complete solution has not been found yet to the problem of preventing the pollution of the atmosphere with noxious emissions. Therefore, at present primary attention is paid to partial solution of this problem.

Under urban driving conditions frequent stops and gear-changes as well as the use of the engine for braking make it necessary for the carburetor engine to idle, decelerate and to accelerate from deceleration for about half the entire driving time. Deceleration is to be understood herein to mean the operating conditions under which, with the throttle closed, the engine crankshaft is caused to rotate at above the normal slow idling speed. The aforementioned modes of engine operation have a great effect on both the general amount of auto emissions and the formation of local zones with the maximum concentration of exhaust fumes in the atmosphere, for example, at crossings or traffic lights.

A possible way to materially reduce noxious emissions from carburetor engines of the internal combustion type is to improve the fuel combustion conditions at idling.

Known in the art is a device for reducing noxious emissions from carburetor engines of the internal combustion type (USA Pat. No. 3.688.752) which comprises a body having a main passage for feeding a fuel-air mixture through an intake duct to the engine cylinders and an emulsion passage communicating with a fuel feed means. A throttle valve is fitted in the main passage so as to divide it into an upstream throttle space and a downstream throttle space, as viewed in the direction of the fuel-air mixture flow. The main passage also communicates with said fuel feed means.

The emulsion passage communicates with the upstream throttle space in the area where the throttle valve upper edge locates when the throttle valve is in the closed position and also communicates further, as viewed in the direction of the emulsion flow, via a first adjustable throttling element with a chamber. Said chamber communicates via a passage with the downstream throttle space and via an air passage with the upstream throttle space, there being provided a second throttling element in said air passage.

Said chamber accommodates a movable element adapted to move coaxially with said passage for the purpose of closing same and thereby disconnecting the chamber from the downstream throttle space. The movable element is operated by means of an electromagnet.

In the vicinity of the engine intake valves said downstream throttle space is connected to the atmosphere by means of a bypass in which is fitted said movable element for the purpose of opening it during deceleration.

The emission of noxious substances at light throttle and idle is largely determined by homogeneity and dispersity of the fuel-air mixture.

The device under consideration has no provision for finely atomizing fuel and uniformly mixing it with air when feeding the fuel-air mixture through the chamber, i.e. it does not cater for dispersity and homogeneity of the mixture. This results in non-uniform feed of fuel and air into the engine cylinders because of formation of a film of liquid fuel on the inner wall of the main mixture feed passage. The fuel draining down the main passage wall into the engine cylinders causes overenrichmentof the mixture in some cylinders, which has a detrimental effect on the process of mixture combustion. The operation of an internal combustion engine under these conditions results in increased emissions of carbon monoxide and unburned hydrocarbons into the atomosphere. Besides, incomplete combustion causes increase in fuel consumption.

A considerably large amount of electric current is required to operate the electromagnet for moving the element disconnecting the chamber from the downstream throttle space, which adversely affects the dependability of the vehicle electricals and the vehicle itself. Furthermore, this disadvantage increases power takeoff from the engine, necessitates the use of costly materials and gives an added fire hazard.

A further disadvantage is that the device has to have a bypass which, in order to prevent escape of fuel vapour and film during overrun above the idle speed, must be connected to the downstream throttle space in the vicinity of the engine intake valves, which extremely complicates engine construction.

It is an object of the present invention to reduce noxious emissions from carburetor internal combustion engines, particularly at light throttle and idle, by providing fine fuel atomization and uniform mixing of fuel and air fed into the engine cylinders, whereby emission of carbon monoxide and unburned hydrocarbons into the atmosphere will be reduced and fuel consumption decreased.

It is a further object of the present invention to improve homogeneity of the fuel-air mixture by swirling it in the chamber and the main passage.

It is a still further object of the present invention to simplify the operation of the device for reducing noxious emissions from carburetor engines by providing a constant fuel-air ratio irrespective of the rate of mixture flow.

It is a still further object of the present invention to improve the dependability of the device by improving the dependability of the actuating electrical equipment involved, decreasing power taken off by the electromagnet from the engine, reducing the employment of costly materials, and completely eliminating the cause of fire hazard by decreasing the electric current required to actuate the movable element.

It is the last object of the present invention to simplify the construction of the device for reducing noxious emissions from carburetor engines of the internal combustion type.

According to these and other objects of the invention, there is provided a device for reducing noxious emissions from carburetor engines of the internal combustion type, the body of which comprises at least one main passage designed to feed a fuel-air mixture to the engine cylinders and accomodating a throttle valve which divides said main passage into an upstream throttle space and a downstream throttle space, as viewed in the direction of the fuel-air mixture flow. Said body of said device also comprises an emulsion passage which communicates with the upstream throttle space substantially in the area where the throttle valve upper edge locates when the throttle valve is in the closed position and also communicates further, as viewed in the direction of the emulsion flow, via an adjustable throttling element with a chamber which communicates via a passage with the downstream throttle space and via an air passage with the upstream throttle space. Said chamber accommodates a movable element adapted to move coaxially with said passage for the purpose of closing same. A sleeve is installed in the chamber in such a manner that a narrow annular passage is formed between the inner wall of the sleeve and the outer wall of the movable element, which annular passage connects with said emulsion passage downstream of the adjustable throttling element with respect to the direction of the emulsion flow and separates the chamber space communicating with the downstream throttle space from the chamber space communicating with the upstream throttle space.

It is desirable that the outlet hole of the air passage connecting the chamber space with the upstream throttle space be positioned tangentially to the inner surface of the chamber.

It is further desirable that the outlet hole of the passage connecting the chamber space with the downstream throttle space be positioned tangentially to the inner surface of the main passage.

This constructional arrangement of the device promotes reducing carbon monoxide and hydrocarbon emissions and decreasing fuel consumption at idle and light throttle by improving the processes of mixture formation and combustion at idle and light throttle and cutting off the mixture during deceleration. Due to the tangential position of the air passage outlet hole, the air going from the upstream throttle space into the chamber flows over the chamber surface, becomes swirled, and gets into the annular passage. Depression in the annular passage causes the air to move at nearly sonic velocity, which facilitates fine atomization of the fuel supplied via the emulsion passage to the annular passage. Besides, the air swirl provides for uniform mixing of the air and fuel. During further travel the fuel-air mixture gets into the chamber portion where the mixture velocity drops sharply. Then the mixture is accelerated again at the entry to the passage which connects the chamber to the main passage. Leaving said connecting passage, the mixture slows down, goes into a swirl round the surface of the main passage and proceeds to the engine cylinders. Abrupt changes in the velocity and pressure of the fuel-air mixture in the path of its movement in the device facilitate atomization of fuel drops and uniform distribution thereof in the mixture, which lowers the limits of weakening the mixture, makes the combustion thereof more complete and thereby reduces fuel consumption and emission of carbon monoxide and hydrocarbons.

It is still further desirable that the outer surface of the movable element and the inner surface of the sleeve should form a convergent portion of the annular passage at the chamber side which communicates with the upstream throttle space, said surfaces forming a divergent portion of the annular passage at the chamber side which communicates with the downstream throttle space.

This constructional arrangement affords the device simplicity of operational regulation by virtue of maintaining constant fuel-air ratio irrespective of the rate of mixture flow. For this purpose the profiles of the convergent and divergent portions of the annular passage are to be chosen so that with a change in the position of the movable element the rate of fuel flow from the emulsion passage varies in proportion to the variation of the rate of air flow through the annular passage.

The angles of taper of the convergent and divergent portions of the annular passage are to be chosen according to the constructional features of the engine, the modes of its operation and the weight class of the vehicle.

For effecting axial movement of the movable element, the latter may be connected to an adjusting screw by the use of which the idle speed of the engine can be varied with the fuel-air ratio remaining constant.

In some cases simplification of the device constituting the present invention may be achieved to the detriment of economical and pollution-free operation of the engine during deceleration by rigidly connecting the movable element to the adjusting screw.

In order to cut off the fuel-air mixture and reduce carbon oxide and hydrocarbon emissions during deceleration, it may be expedient to adapt the movable element to be moved axially by attaching it to a movable diaphragm incorporated in a pneumatic servomechanism whose working space is connected to the atmosphere and is arranged to communicate with the downstream throttle space via an electomagnetic valve controlled with respect to the engine speed and the position of the throttle valve.

The use of a conventional pneumatic servomechanism in the device for reducing noxious emissions from a carburetor engine makes it possible to improve the performance and economy characteristics of said device. With such a constructional arrangement, the electric current needed to actuate the movable element can be decreased 10 to 40 times. The resultant decrease in the requried number of ampere-turns of the electromagnet winding makes for decreasing the dimensions of the device. Due to a lower current in the winding of the electro-magnetic valve, the associated switchgear is simplified and dependability of the device improved. Furthermore, fire hazards in connection with the device are minimized inasmuch as low current passes across the contacts of the switchgear. Besides, the need for costly non-ferrous and other materials is cut down with resultant cut-down of manufacturing costs. At last, double conversion of energy is eliminated, whereby power consumption is reduced.

It is recommended that, for adapting the movable element to be moved axially, said element be attached to a movable diaphragm incorporated in a pneumatic servomechanism whose working space is connected to the atmosphere via a passage leading into the upstream throttle space substantially in the area where the throttle valve upper edge locates when the throttle valve is in the closed position, said working space being arranged to communicate with the downstream throttle space via an electromagnetic valve controlled with respect to the engine speed.

This constructional arrangement eliminates the need for an electrical throttle valve position pickup, which, as stated above, eliminates fire hazards and improves the dependability of the device.

In urban driving conditions wherein the engine operates mainly at light throttle, idle and deceleration, the use of the device constituting the present invention provides for decreasing fuel consumption by 4 to 7 percent and reducing carbon monoxide and hydrocarbon emissions by 20 to 40 percent without increase in the emission of nitrogen oxides. Besides, the exhaust gases at idle contain 6 to 10 times less carbon monoxide and 20 to 30 percent less hydrocarbons, the engine running more steadily. The device constituting the present invention renders the use of the engine for braking more efficient and also prevents muffler explosion and run-on with the ignition switch off.

Said device can be fitted to vehicle engines at service stations. Thus, the vehicles already in service can be readily equipped with the device.

Now the invention will be described in detail with reference to the accompanying drawings in which.

Figure 1:
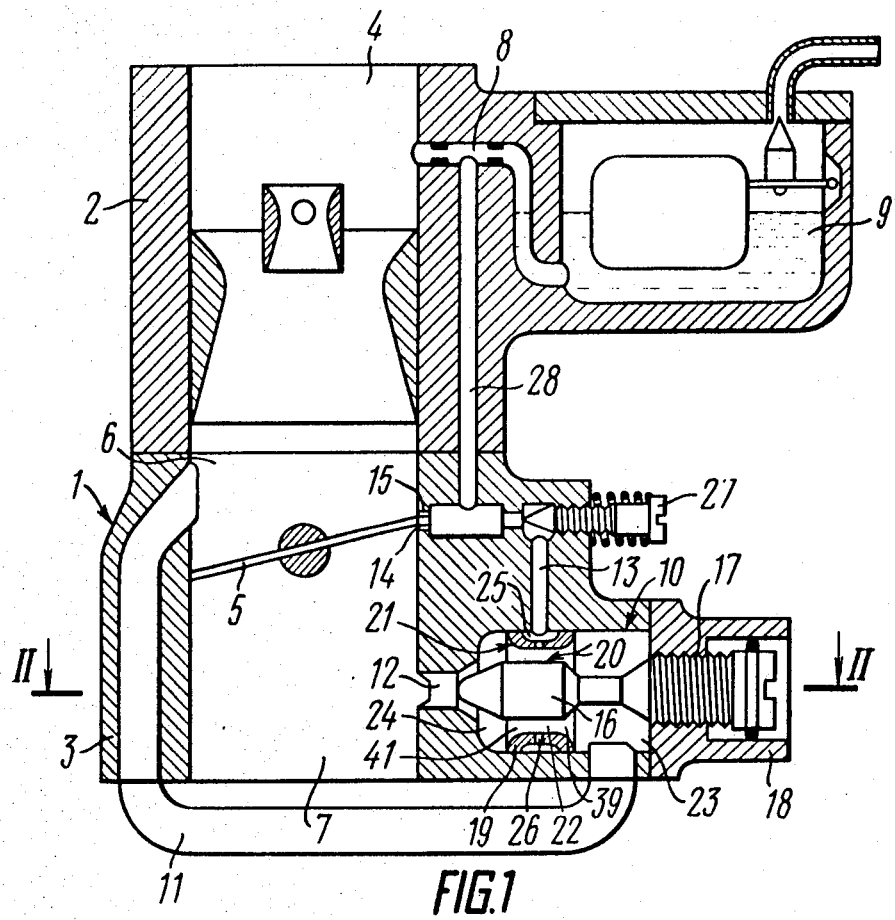
FIG. 1 is a longitudinal sectional view of the device constructed according to the invention, the elements of the device being positioned for idling.

The device constituting the present invention comprises a body 1 (FIG. 1) comprising two parts, viz. part 2 and part 3, in which is located a main passage 4 designed for feeding a fuel-air mixture to the cylinders of the engine (not shown). Installed in the main passage 4 is a throttle valve 5 which divides said main passage into an upstream throttle space 6 and a downstream throttle space 7, as viewed in the direction of the fuel-air mixture flow. the main passage 4 is connected via a passage 8 to a fuel feed means 9.

A chamber 10 is provided in the lower part 3 of the body 1. The chamber 10 communicates through an air passage 11 with the upstream throttle space 6 and through a passage 12 with the downstream throttle space 7. The part 3 has a passage 13 which leads to the chamber 10 and communicates via holes 14 and 15 with the upstream throttle space 6 substantially in the area where the throttle valve upper edge locates when the throttle valve is in the closed position.

The chamber 10 accommodates an axially movable element 16 connected to an adjusting screw 17 whose threaded portion is screwed into a cover 18 attached to the lower part 3 of the body 1. When moved in the appropriate direction, the element 16 closes the passage 12, thereby disconnecting the downstream throttle space 7 from the chamber 10.

A sleeve 19 is installed in the chamber 10 in such a manner that a narrow annular passage 22 is formed between the outer wall 20 of the element 16 and the inner wall 21 of the sleeve 19. The annular passage 22 separates a chamber space 23 which is connected by the passage 11 to the upstream throttle space 6 from the chamber space 24 which is connected by the passage 12 to the downstream throttle space 7. The sleeve 19 has a groove 25 which communicates with the annular passage 22 via orifices 26 calibrated for the required rate of fuel-air emulsion flow. The passage 13 leads into the groove 25 and accommodates an adjustable throttling element 27. An emulsion passage 28 connects the passage 13 to the fuel feed means 9.

By the use of the sleeve 19 installed in the chamber 10 in such a manner that the annular passage 22 is formed between the inner wall 21 of the sleeve 19 and the outer wall 20 of the element 16, which annular passage 22 communicates via the adjustable throttling element 27 with the fuel feed means 9 and forms the chamber space 23 communicating with the upstream throttle space 6 and the chamber space 24 communicating with the downstream throttle space 7, provision is made for fine atomization of fuel and mixing of fuel and air.

Figure 2:
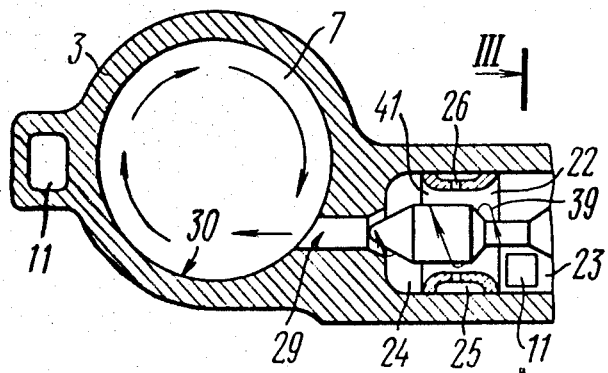
FIG. 2 is a section on the line II—II of FIG. 1.

The hole 29 (FIG. 2) of the passage 12 is tangential to the inner surface 30 of the main passage 4, which provides for swirling the fuel-air mixture for the purpose of further improving the homogeneity of the fuel-air mixture.

Figure 3:
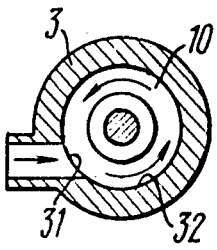
FIG. 3 is a section on the line III—III of FIG. 2.

The hole 31 (FIG. 3) of the passage 11 is tangential to the inner surface 32 of the chamber 10, which provides for swirling the air delivered through the passage 11 for the purpose of further improving the homogeneity of the fuel-air mixture.

The device constituting the present invention operates as follows:

On the suction stroke in the internal combustion engine depression is created in the downstream throttle space 7. Inasmuch as the air pressure in the upstream throttle space 6 is above that in the downstream throttle space 7, depression is produced in the emulsion passage 28 by virtue of which fuel-air emulsion is sucked from the fuel feed means 9 into the passage 13. The fuel-air emulsion gets into the groove 25 and thence, via orifices 26, into the annular passage 22.

Since the air pressure in the chamber 10, the same as in the upstream throttle space 6, is above that in the downstream throttle space 7, the air goes through the passage 11 into the chamber 10 and, issuing from the hole 31, passes round the surface 32 of the chamber 10, going into a swirl, and thereafter moves into the annular passage 22. Depression created in the annular passage 22 causes the air to move at nearly sonic velocity, which results in fine atomization of the fuel flowing through the orifices 26 into the annular passage 22. The accompanying air swirl provides for uniform mixing of the air and fuel.

From the annular passage 22 the fuel-air mixture proceeds into the space 24 where the mixture velocity drops sharply. Then, at the entry to the passage 12, the fuel-air mixture is accelerated again. Leaving the passage 12 via the hole 29, the fuel-air mixture slows down and, passing round the surface 30 of the main passage 4, goes into a swirl and proceeds to the engine cylinders. Abrupt changes in the velocity and pressure of the fuel-air pressure in its path through the device facilitate atomization of the fuel drops and uniform distribution thereof in the mixture, whereby provision is made for weakening the mixture and improving the combustion process with consequent decrease in fuel consumption and reduction of carbon monoxide and hydrocarbon emissions.

Figure 4:
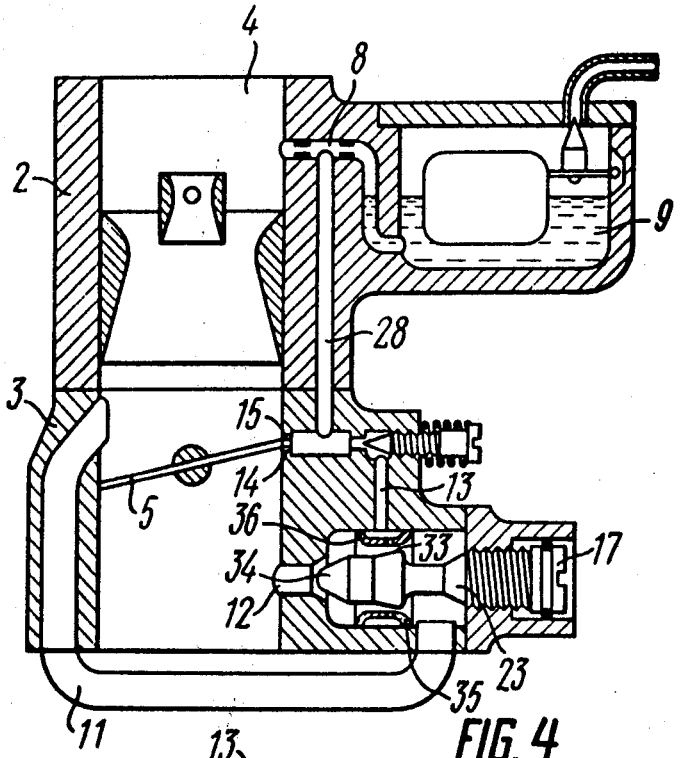
FIG. 4 is a longitudinal sectional view showing the chamber of the device and an embodiment of the movable element.
Figure 5:
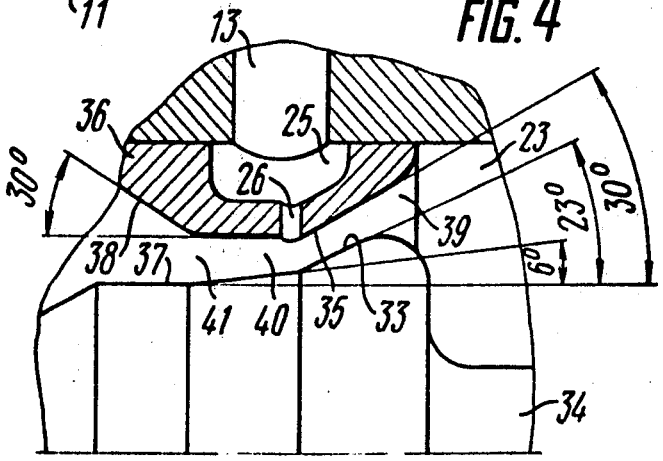
FIG. 5 is an enlarged view showing an embodiment of the annular passage.

An embodiment is possible wherein the outer surface 33 (FIG. 4) of movable element 34 and the inner surface 35 of a sleeve 36, and also the outer surface 37 of the element 34 and the inner surface 38 of the sleeve 36 may be of tapered form so as to form a convergent portion 39 (FIG. 5) of an annular passage 40 at the space 23 of the chamber 10 and a divergent portion 41 of the annular passage 40 at the space 24.

With this construction, during the operation of the device the fuel-air emulsion gets into the grove 25 in the sleeve 36 as described above and thence, via the orifices 26, into the annular passage 40. The air swirl gets into the annular passage 40 as described above. In the convergent portion 39 the air velocity increases and in the divergent portion 41 of the annular passage 40 the air is accelerated to nearly sonic velocity, whereby the fuel flowing via the orifices 26 into the annular passage 40 is finely atomized up to a molecular state.

In the embodiment described herein, the taper surfaces 33 and 35 are inclined to the longitudinal axis of the element 34 at an angle of 23° and 30° respectively, and the taper surfaces 37 and 38 are inclined at an angle of 6° and 30° respectively, whereby provision is made for maintaining a constant ratio between the air flowing through the annular passage 40 and the fuel flowing via the orifices 26 into the annular passage 40. This constructional arrangement makes it possible to adjust the engine idling speed, with a constant fuel-air ratio, by the use of the adjusting screw 17 alone. The optimum taper angles of the annular passage convergent and divergent portions for an engine of 1.45 liters displacement are given in FIG. 45.

Figure 6:
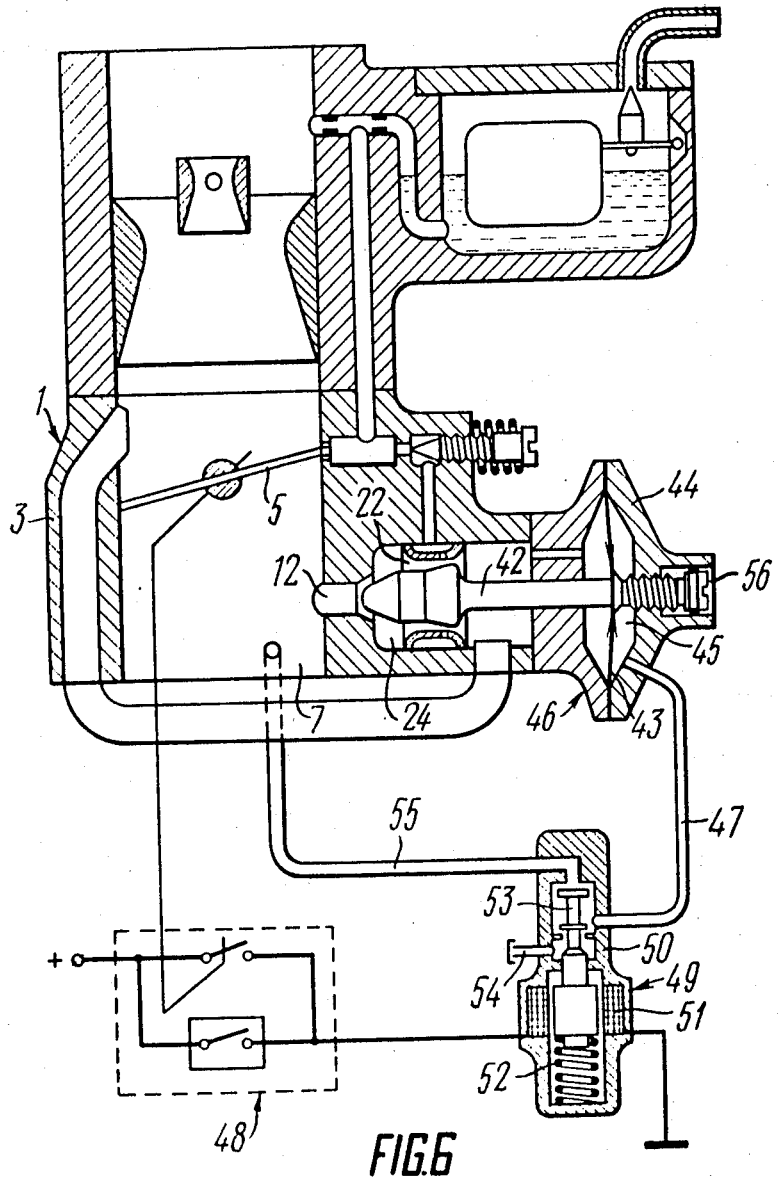
FIG. 6 is a longitudinal sectional view showing another embodiment of the device, with the elements thereof positioned for idling.

A still another embodiment is possible wherein an element 42 (FIG. 6) is connected to a movable diaphragm 43 installed between the lower part 3 of the body 1 and a cover 44. The working space 45 of the pneumatic servomechanism 46 communicates via a passage 47 with a two-position electro-magnetic valve 49 controlled by a control unit 48 with respect to the position of the throttle valve 5 and the engine speed. The valve 49 comprises a body 50 which accommodates an electromagnet 51 and a movable element 53 loaded by a spring 52. Depending on the position of the throttle valve 5 and the engine speed, the valve 49 alternately connects the space 45 with the atmosphere via a passage 54 and with the downstream throttle space 7 via a passage 55.

Figure 7:
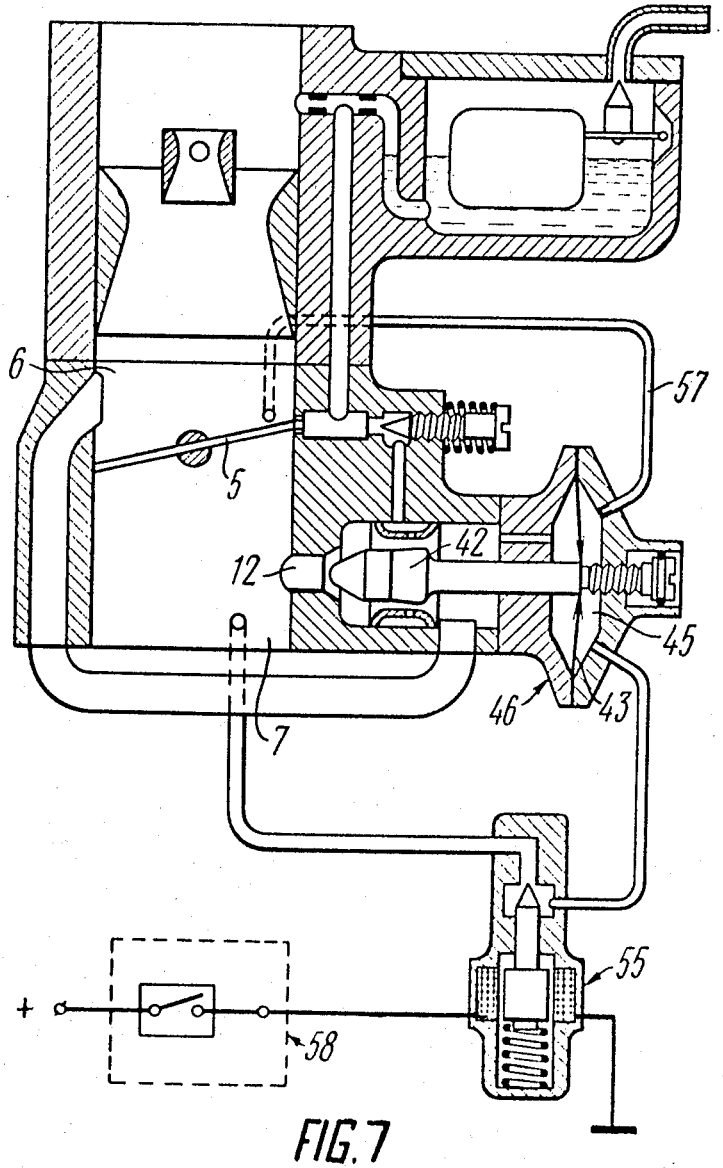
FIG. 7 is a longitudinal sectional view of still another embodiment of the device.

Fitted in the cover 44 is a screw 56 designed for adjusting the engine idling speed by varying the position of the element 42 through the diaphragm 43. The working space 45 of the pneumatic servomechanism can be put in communication with the atmosphere via a passage 57 (FIG. 7) which leads into the upstream throttle space 6 in the area where the throttle valve upper edge locates when the throttle valve 5 is in the closed position. With this constructional arrangement, the control unit 58 responds only to the engine speed.

In this case, with the throttle valve 5 closed and the engine running at the idle speed, a signal is sent to the control unit 48 (FIG. 6) and the latter makes the valve 49 connect the working space 45 with the downstream throttle space 7. Inasmuch as the air pressure in the downstream throttle space is less than the atmospheric pressure, the diaphragm 43 is caused to move towards the cover 44, thereby shifting the element 42 and opening the passage 12. The downstream throttle space 7 connects with the space 24 of the chamber 10 and the device operates as described above. Little current is required to operate the valve 49 inasmuch as the movement of the element 42 is effected by pressure drop across the diaphragm 43.

When, with the throttle valve 5 closed, the engine over-runs the minimum steady idle speed by 200 to 400 rpm, the valve 49 disconnects the working space 45 from the downstream throttle space 7 and, due to the working space 45 being connected with the atmosphere via the hole 54, the pressure in the working space 45 increases to atmospheric. As a result, the diaphragm 43 moves into the initial position and shifts the element 42, closing the passage 12 and thereby cutting off the fuel-air mixture in the event of overrun above the idle speed.

In another case, with the throttle valve 5 closed, the working space 45 (FIG. 7) communicates through a passage 57 with the upstream throttle space 6 wherein the pressure is equal to atmospheric. At the engine idling speed a control unit 58 causes the valve 55 to keep the working space 45 in communication with the downstream throttle space 7, the device working as described above for the idling conditions. In the event of the engine overrunning the idle speed by 200 to 400 rpm, the control unit 58 disconnects the working space 45 from the downstream throttle space 7, the pressure in the working space 45 increases to atomospheric due to the working space 45 being put in communication with the upstream throttle space 6 via the passage 57, and the device operates as described above for the deceleration conditions.

It will be observed that inasmuch as the signal in response to closing the throttle valve 5 is sent past the control unit directly to the diaphragm 43 which operates the element 42, the dependability of the device is improved and the need for pickups to respond to the position of the throttle valve 5 is eliminated.

Experimental devices constructed according to the present invention have been fitted to cars and tested under urban driving conditions. The tests have shown 4 to 7 percent decrease in fuel consumption and 20 to 40 percent reduction of carbon monoxide and hydrocarbon emissions without increase in the emission of nitrogen oxides. The content of carbon monoxide in the engine exhaust fumes at idling is reduced 6 to 10 times and the content of hydrocarbons is reduced 20 to 30 percent, the engine operation being more steady. The use of the engine for braking becomes more efficient and causes no muffler explosions. Run-on with the ignition off is eliminated.

It is to be understood that the embodiments described herein by way of example will be constructed as broadly as the scope of the following claims will permit.

What is claimed is:

1. A device for reducing noxious emissions from carburetor internal combustion engines, comprising: a body; at least one main passage provided in said body for feeding a fuel-air mixture to the engine cylinders; a throttle valve installed in said main passage so as to divide it into an upstream throttle space and a downstream throttle space, as viewed in the direction of the fuel-air mixtue flow; an emulsion passage provided in said body and communicating with said upstream throttle space substantially in the area where the throttle valve upper edge locates when the throttle valve is in the closed position; an adjustable throttling element fitted in said body and adapted to close said emulsion passage; a chamber provided in said body defined by a cylindrical inner surface, which chamber connects with said emulsion passage downstream of the adjustable throttling element, as viewed in the direction of the emulsion flow, and communicates with said upstream throttle space and said downstream throttle space; a first air passage located in said body fluidly interconnecting said chamber to said upstream throttle space, said first air passage opening into said chamber substantially tangentially to the inner surface thereof; a second passage provided in said body fluidly interconnecting said chamber to said downstream throttle space; a movable element installed in said chamber and adapted to move coaxially with said second passage for the purpose of closing same; a means for shifting said movable element axially with respect to said second passage; a sleeve installed in said chamber in such a manner that a narrow annular passage is formed between the inner wall of said sleeve and the outer wall of said movable element, which annular passage connects with said emulsion passage downstream of said adjustable throttling element with respect to the direction of the emulsion flow and separates the space of said chamber communicating with the downstream throttle space from the space of said chamber communicating with said upstream space.

2. A device as claimed in claim 1, wherein the outlet hole of the passage connecting the chamber space with said downstream throttle space is positioned tangentially to the inner surface of said main passage.

3. A device as claimed in claim 2, wherein the outer surface of said movable element and the inner surface of said sleeve form a convergent portion of said annular passage at the chamber side which communicates with said upstream throttle space, whereas said surfaces form a divergent portion of said annular passage at the chamber side which communicates with said downstream throttle space.

4. A device as claimed in claim 3, wherein the means for axial movement of said movable element is essentially an adjusting screw.

5. A device as claimed in claim 3, comprising: a pneumatic servomechanism; a movable diaphragm incorporated in said pneumatic servomechanism and connected to said movable element, said diaphragm serving as a means for axial movement of the movable element and confining the working space thereof; an electromagnetic valve controlled with respect to the engine speed and the position of said throttle valve, said working space of said pneumatic servomechanism communicating with the atmosphere and, via said electromagnetic valve, with said downstream throttle space.

6. A device as claimed in claim 3, comprising: a pneumatic servomechanism; a movable diaphragm incorporated in said pneumatic servomechanism and connected to said movable element, said diaphragm serving as a means for axial movement of the movable element and confining the working space thereof; an electromagnetic valve controlled with respect to the engine speed; a passage connecting said working space with said upstream throttle space, said working space being connected with said downstream throttle space via said electromagnetic valve.

* * * * *